United States Patent [19]

Howlett

[11] 4,146,951

[45] Apr. 3, 1979

[54] METHOD AND APPARATUS FOR TENSIONING CONCRETE REINFORCING TENDONS

[75] Inventor: George H. Howlett, Oakland, Calif.

[73] Assignee: Howlett Machine Works, Berkeley, Calif.

[21] Appl. No.: 698,771

[22] Filed: Jun. 22, 1976

[51] Int. Cl.[2] ..... B21D 39/00; E04C 5/08; F16B 2/12

[52] U.S. Cl. ..... 29/452; 52/224; 403/314

[58] Field of Search ..... 29/452, 506; 85/83; 52/224; 403/314

[56] References Cited

U.S. PATENT DOCUMENTS

| | | | |
|---|---|---|---|
| 3,253,332 | 5/1966 | Howlett et al. | 29/506 |
| 3,518,748 | 7/1970 | Howlett | 29/452 |
| 3,837,258 | 9/1974 | Williams | 85/83 X |

*Primary Examiner*—Charlie T. Moon

*Attorney, Agent, or Firm*—Warren, Chickering & Grunewald

[57] ABSTRACT

A method and apparatus for tensioning concrete reinforcing tendons or the like are disclosed which are particularly well suited for use in the construction of prestressed concrete tanks. The method includes mounting a wedge assembly on the tendon and mounting a wedge assembly housing around the wedge assembly, with the improvement being comprised of the steps of forming a spiral groove of relatively shallow depth in the tendon prior to mounting the wedge assembly thereon, and rotating the housing in a manner similar to a turnbuckle to simultaneously and proportionally induce radial tendon gripping forces in the wedge assembly and substantial axial tension forces in the tendon. The method has the additional advantage of preventing relative slippage between the wedge assembly and tendon even when conventional tendon jacking techniques are employed to tension the tendon.

7 Claims, 3 Drawing Figures

METHOD AND APPARATUS FOR TENSIONING CONCRETE REINFORCING TENDONS

BACKGROUND OF THE INVENTION

The securement of concrete reinforcing tendons by convergently movable wedge assemblies is well known in the concrete prestressing art. Most such concrete anchorages employ a wedge assembly having a continuously tapered frusto-conical exterior surface which mates with a similarly formed frusto-conical bore in an anchor plate or housing. In addition to the conventional tapered wedge assembly, wedge assemblies have been devised in which the exterior surface of the wedge assembly includes a spiral array of adjacent convergently tapered camming areas which mate with a similarly formed bore in an anchor plate or housing. Such an anchorage is disclosed in U.S. Pat. No. 2,930,642.

It was subsequently discovered that anchorages of the type described in U.S. Pat. No. 2,930,642 could be extremely advantageously employed in a concrete prestressing method particularly well suited to the prestressing of large concrete tanks. This subsequent method is described in detail in U.S. Pat. No. 3,518,748. As is described in U.S. Pat. No. 3,518,748, one of the standard techniques which has been previously employed in post-tensioning concrete tanks was the use of threaded turnbuckles. The principal disadvantage found through the use of turnbuckles was that they depended upon threading the ends of the rods or tendons on which they were mounted, thus reducing the tensile strength of the tendons to undesirably low levels. Additionally, the turnbuckles which had been employed were formed of a material having approximately the same hardness as the tendons themselves. Thus, when turnbuckles were employed, the turnbuckle would freeze up as a result of galling of either the turnbuckle or tendon under the friction forces generated long before an axial load or tension force which was adequate could be generated by the turnbuckles in the tendons. The solution set forth in U.S. Pat. No. 3,518,748 was to couple the tendons together by a coupler having convergently movable wedges, tension the tendons by jacking them toward each other, relaxing the tendons so that the wedges would pick up most of the tension load, re-tensioning the tendons with the jacking means, and rotating the coupler to take up the slack in the coupler caused by re-tensioning. After the slack was removed, the jacking forces can be relaxed and the coupler will take up the full tension force on the tendon.

While the approach of U.S. Pat. No. 3,518,748 has been employed extensively, there are certain applications in which it may have disadvantages, and in some instances the tensioning, relaxing and re-tensioning approach has resulted in some instances of the anchorage being unable to hold the re-tensioned load, which has required undesirable replacement of wedge assemblies.

While the turnbuckle approach to concrete tank prestressing has the disadvantages of decreasing the overall strength of the reinforcing tendons by threading the same and freezing up of the turnbuckle under friction forces and galling at undesirably low tension levels, turnbuckles have the advantages of not requiring jacks, tensioning tongs or other specialized equipment. Thus, conventional and readily available tools can be used to rotate the turnbuckle elements and induce tension forces. Therefore, if the inherent reduction in tendon strength and reduction in the forces which can be induced by the turnbuckle can be overcome, the use of turnbuckle systems for post-tensioning concrete tanks would again become advantageous.

OBJECTS OF THE INVENTION

Accordingly, it is an object of the present invention to provide a method for tensioning a reinforcing tendon or the like which has the advantage of not requiring specialized jacking equipment and yet can be used to reliably induce substantial tension forces in the reinforcing tendon.

Another object of the present invention is to provide a method for tensioning a reinforcing tendon which has the simplicity of a turnbuckle system and the reliability of a convergently acting wedge system, all without substantially diminishing the load carrying capability of the reinforcing tendon.

Another object of the present invention is to provide a method for tensioning two opposed and axially aligned tendons in which the tensioning time is reduced and the reliability of the coupling between tendons is increased.

Still a further object of the present invention is to provide a method for preventing relative slippage between the tendon and tendon anchorage.

Another object of the present invention is to provide a tendon tensioning method which can be employed by relatively unskilled labor.

A further object of the present invention is to provide a reinforcing tendon connection or coupling requiring less time to install and having improved reliability.

The method of the present invention has other features of advantage and objects which will become apparent from and are set forth in detail in the following description of the preferred embodiments and the accompanying drawing.

SUMMARY OF THE INVENTION

The method of the present invention for tensioning a reinforcing tendon or the like includes the steps of mounting a convergently movable wedge assembly on the tendon, the wedge assembly being of the type which includes a spiral array of camming areas and a similar spiral array of tendon gripping thread-like teeth, mounting a mating wedge assembly housing on the wedge assembly, with the improvement of the present invention being comprised of the steps of: prior to mounting the wedge assembly on the tendon, forming a spiral groove on the exterior surface of the tendon for receipt of the teeth of the wedge assembly therein, and rotating the housing in a direction inducing tension forces in the tendon while simultaneously and proportionally inducing radial gripping forces in the wedge assembly until a substantial axial tension forces is induced in the tendon. In a second aspect of the invention to prevent slippage between the tendon anchorage and the tendon without any substantial reduction in the tension forces which can be withstood by said tendon, a groove is formed in the exterior surface of the tendon to a depth from the nominal outside diameter of the tendon not in excess of about 0.40 millimeters. The apparatus is comprised, briefly of a convergently acting wedge assembly and housing in combination with a tendon having very shallow grooves therein over a length equal to the axial displacement of the tendon during tensioning.

DESCRIPTION OF THE PREFERRED EMBODIMENT

As used throughout this application, the expression "tendon" shall include concrete reinforcing bars, rods, wires or strands. Although most post-tensioned tanks using the method and apparatus of the present invention employ high strength bars, the benefits of the present invention can be achieved to some degree with other conventional reinforcing elements, including strand or cable.

Figure 1:
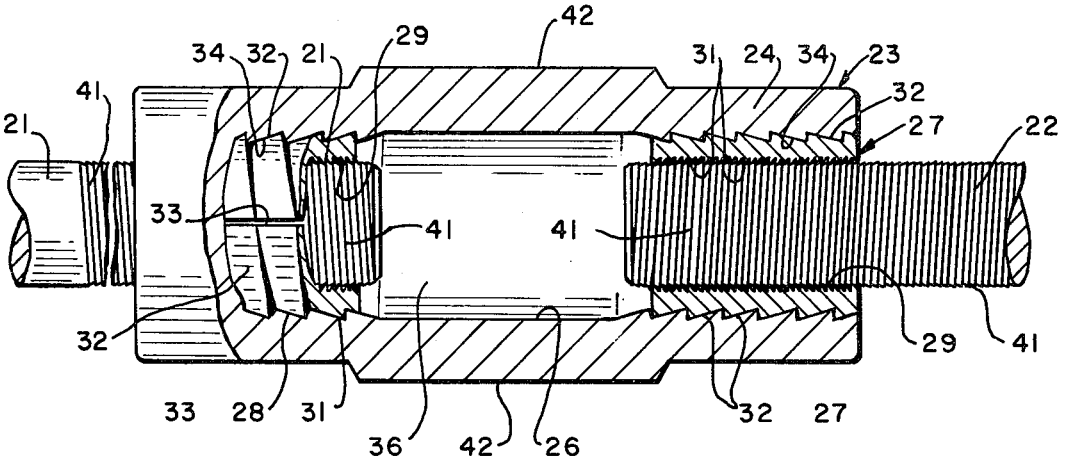
FIG. 1 is a side elevational view, partially in cross-section, of a tendon anchorage showing tendons coupled together in a manner in accordance with the method and apparatus of the present invention.

Referring now to FIG. 1, a concrete anchorage of the type suitable for use with the method of the present invention can be briefly described. Since this anchorage is substantially of the same construction as is shown in U.S. Pat. Nos. 2,930,642 and 3,518,748, some of the details of construction and operation have not been repeated herein. A pair of tendons 21 and 22 are shown mounted in general axial alignment with a tendon coupler generally designated as 23 standing between and connecting the tendons. Coupler 23 includes a substantially cylindrical housing means 24 having a longitudinally extending bore 26 therein with convergently acting wedge assemblies 27 and 28 positioned proximate to the ends of bore 26. Wedge assemblies 27 and 28 are formed in substantially the same manner and each include a central bore 29 dimensioned for receipt of tendons 21 and 22 therein. Moreover, central bore 29 of wedge assemblies 27 and 28 includes a plurality of tendon gripping thread-like teeth designed to engage the reinforcing tendons. Teeth 31 are preferably formed to extend in a spiral array of continuous groove in a manner similar to a bolt thread or the like. The direction in which the teeth spiral in the two wedge assemblies is opposed so that the right-hand wedge assembly has a right-hand spiral, while the left-hand wedge assembly has a left-hand spiral of teeth 31.

In order to induce convergent movement of the wedge assemblies 27 and 28 so as to radially grip tendons 21 and 22, the wedge assemblies are provided with an exterior surface in the form of adjacent convergently tapered camming areas 32 which are also connected in a continuous spiral array, best seen on the left-hand wedge assembly 28. The direction in which the camming areas 32 spiral on the outside of the wedge assembly is of the same hand as the direction of spiraling of the teeth 31 which engage the tendons, as will be more fully set forth hereinafter. Each of the wedge assemblies 26 and 27 is also formed with a slot 33 (shown in the left-hand wedge assembly) which enables the segments of the wedge assembly to converge radially about the tendons. Mating with the exterior camming surfaces or areas 32 on the wedge assemblies is a spiral camming surface or area 34 formed at the ends of bore 26 in the sleeve-like housing 23.

From the above description of the tendon anchorage, it will be apparent that tension forces which tend to separate or displace tendons 21 and 22 axially away from each other will also tend to carry the wedge assemblies axially within sleeve 23 outwardly of the ends of the sleeve. Such a displacement of the wedge assemblies, however, causes the spiral camming surfaces 32 and 34 to inwardly displace the segments of the wedge assemblies so as to grip the tendons with a high radially gripping force. As it will also be appreciated, the radial gripping force on the tendons is proportional to the axial displacement of the tendons.

As thus far described, the concrete reinforcing at tendon coupling of FIG. 1 is well known in the prior art. In the prior art, the coupling has been used by jacking tendons 21 and 22 axially towards each other with a jack or tensioning tongs and simultaneously rotating the housing 23 so that the wedge assemblies are screwed axially toward each other and take up the slack in the coupling induced by the jack or tensioning tongs. In prior art methods, such as U.S. Pat. No. 3,518,748, however, the tendons 21 and 22 are initially inserted into the wedge assemblies of the coupler with a totally smooth exterior surface on the bars or tendons. The wedge assemblies 27 and 28 were preferably formed so that they would have an interferance fit with the outside diameter of the tendons and thereby the teeth 31 would tend to grip and bite in to the exterior surface of the tendons. Thus, the tendons would be tensioned and then relaxed to allow the wedge assembly teeth to bit into the outside surface of the tendons, with the resultant loss in the tension forces that were actually carried by the wedge assembly coupler as compared to the tension forces attained by the jack or tensioning tongs. In the prior art, therefore, it was preferred that the tensioning tongs be again used to retension the tendons with the coupler being rotated to take up the slack on retensioning.

It was found, however, that in using this prior art method, the axial displacement of the ends of the tendons inside the coupling, and particularly in the central area 36 of the coupling, was great enough that the slack could not normally be taken up simply by rotating the wedge assemblies inside the sleeve-like housing. Instead, the tendons had to be axially pushed towards each other with the result that the teeth 31 which had bitten into the exterior surface of the tendons would have to bump over the grooves formed by adjacent teeth to a new smooth area of the tendon, at least at the front end of each of the wedge assemblies. This bumping of the wedge assembly teeth out of the grooves which they have formed and into axially advanced areas, at least some of which were not grooved, resulted in the fatiguing of teeth 31 and in some cases even failure or breaking of the teeth. When fatiguing or failure of the the teeth occurred, they may not adequately bite into the new smooth area of the tendon, with the result that relative slippage between the tendon and the wedge assemblies would occur after the retensioning step when the jacking forces were relaxed. This slippage would necessitate removal of the coupler and replacement of the wedge assemblies which was undesirably time-consuming.

In order to eliminate this slippage problem in one aspect of the present invention, the method includes the improvement comprising the step of prior to any tensioning of the tendons, forming at least one groove 41 in the exterior surface of the tendons. Grove 41 is dimensioned for receipt of the ends of tendon gripping teeth 31 and is further formed to a depth which is determined from the outside diameter of the tendons and is not in excess of about 0.40 millimeters (about 0.015 inches). Thus, an extremely shallow grove or grooves 41 is formed in the exterior surface of the tendons 21 and 22 prior to their placement in the coupler for tensioning.

Groove 41 is preferably in the form of a continuous spiral of like hand to the direction of spiral of the teeth of the wedge assembly into which the tendon is to be inserted. The formation of groove 41 as a spiral enables the use of the assembly of FIG. 1 as a turnbuckle in a manner which will be described in detail hereinafter. It is possible, however, to form groove 41 as a plurality of separate circular grooves, rather than a continuous spiral. When groove 41 is formed as a plurality of grooves, it will be effective in preventing slippage in the coupling of FIG. 1 when the conventional tensioning technique of axially jacking the tendons towards each other to induce tension forces is employed. The formation of groove 41 has the effect of allowing teeth 31 to effectively grip the tendons without having to dig in to the exterior surface of the tendons to such a degree that the teeth are fatigued when they are bumped or axially advanced along the grooves between the first tensioning and the retensioning steps. When the teeth 31 reach their axially advanced position, they will immediately drop down into a pre-formed groove.

It is an important aspect of the present invention that the grooves not be in excess of about 0.40 millimeters. The grooves 41 and the method of the present invention do not contemplate the formation of what would amount to threads in the ends of the tendons. A threaded tendon which mated with a threaded bore in the wedge assembly not only is not required for the method and apparatus of the present invention, but would undesirably reduce the strength of the tendon being couples. There are two aspects of groove 41 that distinguish it from a threaded end. First, the depth of the groove is much more shallow than even the finest threads which might be employed on an equivalent diameter reinforcing bar. Thus, the finest threads that might reasonably be employed would be about 0.75 millimeters and might more typically range up to 2.0 millimeters in depth. Such a groove in each side of the bar would reduce its strength to a level which is unacceptable. Secondly, when mating threads are employed, the pitch diameter of the threads is extremely important. Since hot-rolled reinforcing bar will vary in diameter from bar to bar and from hot-roll and hot-roll, if one were to thread the end of the bar, all the bars would be threaded to the same pitch diameter, regardless of the outside diameter of the individual bars. In the process of the present invention, the depth of groove 41 is not based upon a predetermined pitch diameter, but instead, is determined from the nominal outside diameter of the bar. Thus, grooves 41 are formed either by a single point tool in a machine lathe which is brought up to the outside diameter of each bar and then advanced radially inwardly to a distance to typically between about 0.1 and 0.2 millimeters. Alternatively, a multiple point tool such as a chaser for cutting screw threads can be employed, but again the chaser is not set to cut threads at a predetermined pitch diameter, but instead is set to cut threads or grooves 41 to a predetermined depth from the nominal outside diameter of the tendon. The diameter of hot-rolled reinforcing tendons varies slightly from tendon to tendon, but varies substantially from hot-roll to hot-roll. Thus, the thread chasers can be brought up to touch the periphery of one bar of a given hot-roll and then radially advanced until they penetrate the bar to a depth of about 0.1 to about 0.2 millimeters, after which they can be left at that depth for all of the bars in the same hot-roll. For the next roll of bars, however, the thread chasers should be reset, again from the outside diameter of the bars or tendons. Occasionally, a bar within a given roll of bars will vary to a degree that a pre-set chaser will not cut any grooves in the end of the bar or grooves which are in excess of 0.40 millimeters. Accordingly, quality control must be exercised, but this possibility has not presented a significant problem in practice.

Figure 2:
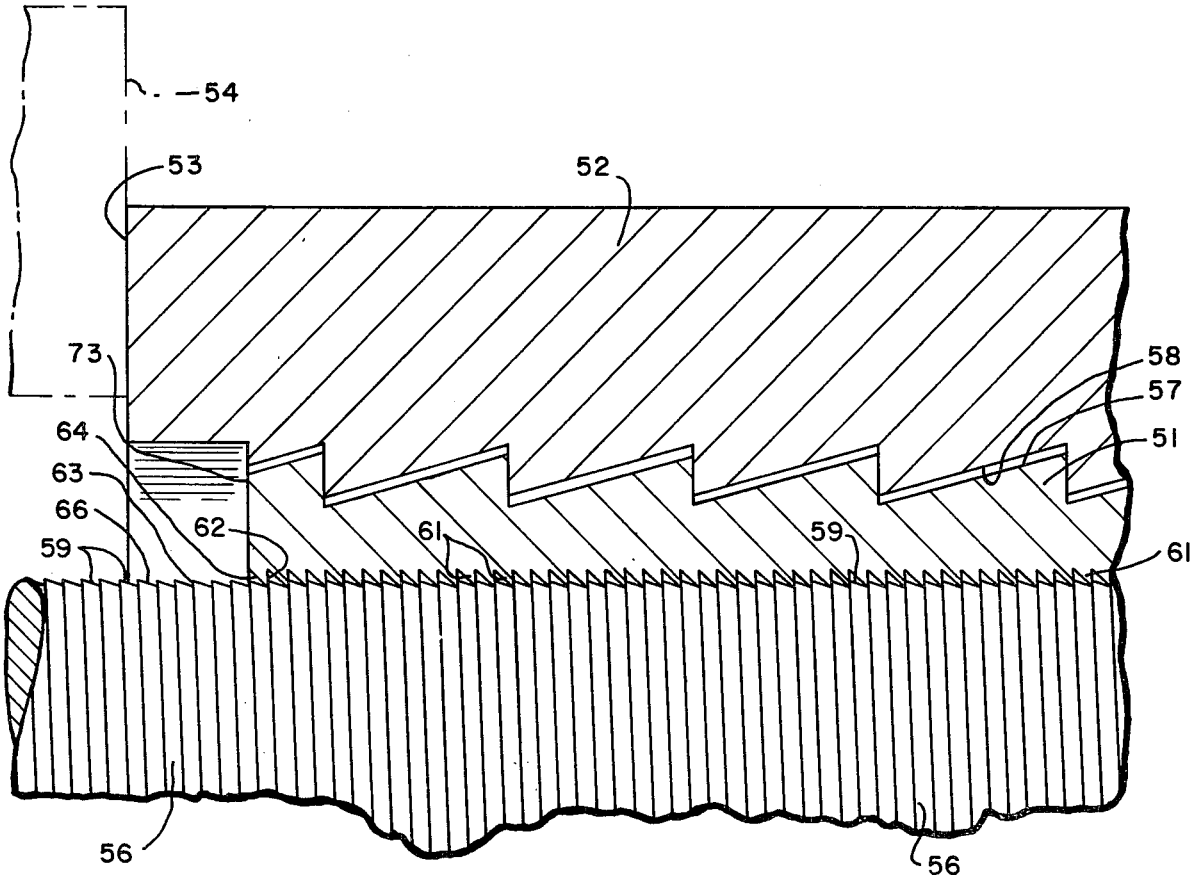
FIG. 2 is an enlarged, fragmentary, side elevational view of an alternative form of tendon anchorage before tensioning forces have been applied to the tendon.
Figure 3:
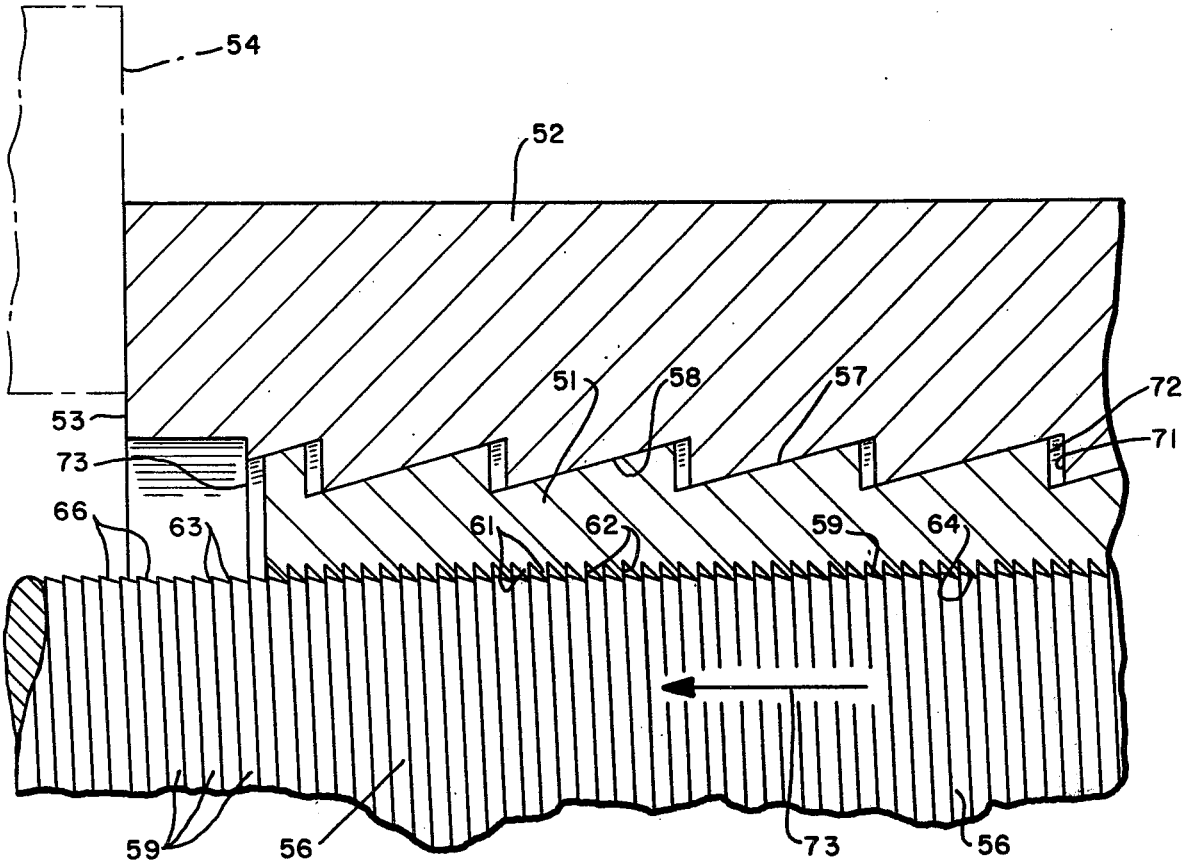
FIG. 3 is an enlarged, fragmentary, side elevational view, in cross-section, corresponding to FIG. 2, but showing the tendon and anchorage in a tensioned condition.

Referring now to FIGS. 2 and 3, the details of the thread construction and operation of the wedge assemblies, as well as the details of the improved method of the present invention can be set forth. In FIGS. 2 and 3, convergently movable wedge assembly 51 is mounted in a wedge assembly receiving housing means 52. Although housing 52 can take the form of a sleeve as shown in FIG. 1, in FIG. 2 the housing means is designed to operate as a nut having a front surface 53 which acts as support means for support of axial forces against a bearing plate or block 54 (shown in phantom). In this embodiment, tendon 56 might be buried in the concrete member instead of extending around the side as would be the case with a post-tensioned tank. Additionally, tendon 56 may only be a relatively short member such as a tieback or stud.

In FIG. 2, the wedge assembly 51 and tendon 56 is shown in an untensioned condition. Thus, the camming surfaces or areas 57 are shown at a radially spaced distance from the corresponding camming tapered surface 58 in housing means 52.

Although they are somewhat exaggerated for the purpose of illustration, FIGS. 2 and 3 do indicate the shallow nature of spiral groove or threads 59, particularly as compared as the depth of the threads or teeth 61 in wedge assembly 51. The threads 51, for example, have a depth of approximately 1.3 millimeters while grooves 59 have a depth of only 0.2 millimeters. As also can be seen from FIGS. 1 and 2, it is preferable that both teeth 61 and grooves 59 be formed as buttress threads, that is, that they have a generally radially extending surface, such as surface 62 on threads 61 and oppositely facing radially extending surfaces 63 on grooves 59, which radial surfaces are connected by sloping surfaces 64 on teeth 61 and 66 on grooves 59. Thus, the buttress thread configuration on the grooves 59 and teeth 61 results in engagement of the oppositely facing radially extending surfaces 62 and 63 so as to resist motion in one direction, while the tapering surfaces 64 and 66 permit relative displacement of tendon 56 with respect to wedge assembly 51 in the opposite direction. It is possible, therefore, to urge tendon 56 to the right with respect to the wedge assembly and the ends of teeth 61 will bump over the tapered surfaces 66 of grooves 59 as the tendon moves to the right. When the tendon attempts to be moved in the opposite direction, however, the radial surfaces 62 and 63 resist such motion. It has been found advantageous to form groove 59 with a buttress thread cross section in which the angle at the apex of the groove is substantially in excess of the angle at the apex of the teeth of the wedge assembly. Thus, the apex of teeth 61 may typically be formed at a 45 degree angle, while the apex of grooves 61 may be formed to have a 75 degree angle.

As will be appreciated, it is preferable that the pitch of groove 59 and the pitch of teeth 61 be substantially identical, notwithstanding the difference in the apex angles between the buttress threads so that the radial surfaces 62 and 63 are at the same spacing from each other for even engagement over the length of the wedge assembly.

FIG. 3 shows the tendon and wedge assembly in a tensioned condition. Thus, the camming surfaces 57 and 58 are in engagement with each other with there now being a separation between the radially extending surfaces 71 and 72. The axially oriented tension force represented by arrow 73 is resisted by interengaged radially extending surfaces 62 and 63 of the teeth and grooves. Unlike conventional turnbuckles, however, the teeth and grooves do not resist the axial tension force solely by sheer forces. Instead, the tapered camming surfaces 57 and 58 cause the wedge assembly to have a high radial gripping force which drives the teeth radially into the grooves. In turnbuckle assemblies, the threads experience no radial gripping force, and the entire load must be carried by the sheer forces which the threads can withstand. In the anchorage and anchor method of the present invention, radial gripping is directly proportional to tension force 73 and increases with increasing tension force to insure a high strength joint.

In another aspect of the present invention, it has been discovered that the anchorage described above enables a turnbuckle type of tensioning of reinforcing tendons without some of the disadvantages which have heretofore been attendant to turnbuckles. Thus, in the improved method of the present invention, a spiral cam wedge assembly and mating housing are employed with improvement comprising the steps of forming a spiral groove such as grooves 41 or 61 in the exterior surface of the tendon prior to mounting the wedge assembly on the tendon, thereafter mounting the wedge assembly on the tendon with the teeth of the wedge assembly in engagement with the groove, supporting the housing means for axial loading (either by support surface 53 bearing upon a stationary member 54 or by a second end of the housing being connected to a second tendon as is shown in FIG. 1), and finally, rotating the housing means while supported to advance the wedge assemblies axially in the housing means in a direction inducing tension forces while simultaneously and proportionally inducing radial gripping forces. Thus, instead of jacking the tendons to attain tension forces and then rotating the housing to take up the slack, in the method of the present invention, no jacking means or special tongs are required and the housing means is simply rotated to advance the wedge assembly, and eventually the tendon in a direction causing tensioning. In FIG. 3, therefore, housing 52 has been rotated from the position in FIG. 1, with the result that wedge assembly 51 has been moved to the right of its position in FIG. 2, as best may be seen by comparison of the position of the front end 73 of the wedge assembly in FIGS. 2 and 3. In fact, what occurs is that upon initial rotation of housing 52, wedge assembly 51 is displaced to the right which begins tensioning. Wedge assembly 51 is, in effect, being screwed to the right out of housing 52. Friction forces, however, even when the wedge assembly is lubricated will eventually prevent further axial displacement of the wedge assembly outwardly of housing 52. If desired, it is an optional feature of the present invention that a protrusion, ring or the like (not shown), can be positioned so as to limit the ability of the wedge assembly to back out of housing 52. Once friction or a limiting protrusion stops further rotation of the wedge assembly in housing 52, the teeth 61 which have a spiral configuration of the same hand as the direction spiral of the caming surfaces, begin to turn in spiral groove 61. The further rotation of housing 52, therefore, causes the teeth 61 to screw down on the tendon and axially advance the tendon to the right, inducing further tension forces in the tendon.

In order to avoid galling and freezing up of the anchorage at low friction forces as is common with conventional turnbuckles, it is a further important feature of the present invention that the wedge assemblies be formed of a material which has a surface hardness substantially in excess of the surface hardness of the tendons. Thus, teeth 61 will typically have a Rockwell C hardness of at least 60 while the tendon surface will have a Rockwell C hardness typically in the range of 15 to 35. This difference in hardness between the teeth and the tendon greatly reduces the incidences of galling. When one material is clearly harder than the other, the soft material tends to act as a bearing with the hard material cutting through the soft. When both materials are of equal hardness, galling is more likely to occur.

Using the method of the present invention, the advantage of simplicity of tensioning of a turnbuckle can be achieved and yet the advantage of radial gripping of a wedge assembly can also be achieved. The result is it is possible to induce significantly higher axial tenison forces in the tendons, and this can be accomplished without forming a thread in the end of the tendon which would reduce the over-all strength of the tendon. Rotation of the housing 52 is preferably continued until the friction forces prevent further advancement of either of the wedge assembly inside the housing means and axial advancement of the tendon inside the wedge assembly. As will be readily appreciated, the apparatus at FIG. 1 can also be employed to tension generally axially aligned tendons with the grooves 41 on tendons 21 and 22 being of opposite hand so as to mate with the corresponding teeth in the wedge assemblies and enable advancement of the tendons toward each other. The sleeve 23 can be advantageously formed with a surface 42 having a hexagonal configuration or a knurled surface to facilitate rotation of the housing with a wrench or the like.

As also best may be seen in FIG. 1, the grooves 41 in tendons 21 and 23 should extend over a length of the tendon in excess of the distance of axial displacement of the tendon during tensioning. This would be true whether the tensioning process is the turnbuckle method of the present invention or conventional jacking. This configuration insures that the teeth of the wedge assembly do not have to form their own groove during the radial gripping and thereby become fatigued if they must be axially advanced to a further position in order to achieve the full tension forces.

Using the present method, the extremely high tension forces which can be achieved by jacking techniques cannot be directly attained; however, as with conventional turnbuckles, it is contemplated that the method will including casting the concrete tank, tensioning the tendons around the outside of the tank by rotating the sleeves 23, and then filling the tank with a liquid, which outwardly displaces the tank walls and raises the tension forces in the tendons to the full load achievable by jacking. Since the coupling sleeves include convergently actuated wedges instead of mere turnbuckles, the increase in tension forces in the tendons will be accompanied by a proportional increase in the radial gripping forces on the tendons by the wedge assemblies.

What is claimed is:

1. In a method for tensioning a reinforcing tendon or the like including the steps of:

i. mounting a convergently movable wedge assembly on said tendon, said wedge assembly including a central tendon receiving bore formed with a plurality of tendon gripping thread-like teeth extending in a spiral array, said teeth having a surface hardness substantially in excess of the surface hardness of said tendon, and said wedge assembly including an exterior surface in the form of adjacent convergently tapered camming areas in a spiral array of like hand to said spiral array of said teeth; and ii. mounting wedge assembly receiving housing means on said wedge assembly, said housing means being formed with a bore therein having camming areas dimensioned for mating engagement with said exterior surface of said wedge assembly to induce convergent movement of said wedge assembly, and said housing means being formed with support means for support of axial forces induced in said housing means;

the improvement in said method comprising the steps of:

a. prior to mounting said wedge assembly on said tendon, forming an extremely shallow spiral groove in the exterior surface of said tendon, said groove being formed for receipt therein of the ends of said teeth of said wedge assembly;

b. mounting said wedge assembly on said tendon with said ends of said teeth mounted in mating engagement with said groove;

c. supporting said housing by said support means for axial loading thereof; and d. rotating said housing means while supported to advance said wedge assembly axially in said housing means in a direction inducing tension forces in said tendon while simultaneously and proportionally inducing radial gripping forces in said wedge assembly until a substantial axial tension force is induced in said tendon by said rotation.

2. A method for tensioning a reinforcing tendon as defined in claim 1 wherein, said forming of a spiral groove in the exterior surface of said tendon is accomplished by forming said groove to a depth from the nominal outside diameter of said tendon of between about 0.10 millimeters and about 0.40 millimeters.

3. In a method for tensioning two opposed and generally axially aligned reinforcing tendons including the steps of:

i. mounting a convergently movable wedge assembly on each of said tendons, each of the wedge assemblies including a central tendon receiving bore formed with a plurality of tendon gripping thread-like teeth, said teeth in a first of said wedge assemblies extending in a spiral array in a first direction and said teeth in a second of said wedge assemblies extending in a spiral array in an opposite direction, said teeth having a surface hardness substantially in excess of the surface hardness of said tendons, and each of said wedge assemblies including an exterior surface in the form of a spiral array of adjacent convergently tapered camming surfaces of like hand to said spiral array of said teeth in the respective wedge assemblies; and ii. coupling said wedge assemblies together by mounting a wedge assembly receiving sleeve on each of said wedge assemblies, said sleeve being formed with a bore therein having a first spiral camming surface formed for mating engagement with said exterior surface of said first wedge assembly and a second spiral camming surface formed for mating engagement with said exterior surface of said second wedge assembly to induce axial and convergent movement of each of said wedge assemblies;

the improvement in said method comprising the steps of:

a. prior to mounting said wedge assemblies on said tendons, forming spiral grooves of opposite hand in each of the exterior surfaces of said tendons, said grooves being formed to a depth not greater than 0.40 millimeters for receipt therein of the ends of said teeth of said wedge assemblies;

b. mounting said wedge assemblies on each of said tendons with said teeth mounted in mating engagement with said grooves; and c. rotating said sleeve to advance said wedge assembly axially in said sleeve toward each other to induce tension forces in both said tendons while simultaneously and proportionally inducing radial gripping forces in said wedge assemblies until a substantial axial tension force is induced in each of said tendons by said rotation.

4. In a method for preventing relative slippage between a tendon and a tendon gripping convergently movable wedge assembly employed in an anchorage for a concrete reinforcing tendon, said method including the steps of:

i. tensioning said tendon by jacking means and positioning said wedge assembly with tendon engaging teeth in said anchorage to support the tensioned tendon;

ii. relaxing the jacking force applied by the jacking means to cause support of the tension forces by said wedge assembly;

iii. re-tensioning said tendon by said jacking means; and iv. while said tendon is re-tensioned, removing any axial slack in said anchorage as a result of convergent movement of said wedge assembly;

the improvement in said method comprising the step of:

prior to said tensioning step, forming at least one groove in the exterior surface of said tendon dimensioned for receipt of the ends of said tendon gripping teeth, said groove being formed to a depth determined solely from the nominal outside diameter of said tendon to be not in excess of about 0.40 millimeters.

5. A method of preventing slippage of a wedge assembly as defined in claim 4 wherein, said forming step is accomplished by forming said groove to a depth in the range of about 0.10 millimeters to about 0.40 millimeters.

6. In an anchorage for securement of a concrete reinforcing tendon under tension including anchor housing means, a convergently acting wedge assembly mounted in said housing means and having a bore therein dimensioned to receive a tendon, said bore being formed with tendon gripping teeth, and a concrete reinforcing tendon positioned in said bore and engaged by said teeth, the improvement comprising:

said tendon having at least one groove therein dimensioned for receipt of the ends of said teeth and extending over a length of said tendon in excess of the distance of axial displacement of said tendon during tensioning, and said groove being formed to a depth of not greater than about 0.40 millimeters from the nominal outside diameter of said tendon.

7. In a method for preventing relative slippage between a tendon and a tendon gripping convergently movable wedge assembly employed in an anchorage for a concrete reinforcing tendon, said method including the steps of:

i. tensioning said tendon by jacking means and positioning said wedge assembly with tendon engaging teeth in said anchorage to support the tensioned tendon;

ii. relaxing the jacking force applied by the jacking means to cause support of the tension forces by said wedge assembly;

iii. re-tensioning said tendon by said jacking means; and iv. while said tendon is re-tensioned, removing any axial slack in said anchorage as a result of convergent movement of said wedge assembly;

the improvement in said method comprising the step of:

prior to said tensioning step, forming at least one groove in the exterior surface of said tendon dimensioned for receipt of the ends of said tendon gripping teeth, said groove being formed to a depth from the nominal outside diameter of said tendon not in excess of about 0.40 millimeters, and said groove being formed with a buttress thread type of cross-sectional shape with a radially extending surface facing away from the direction of advancement of said tendon during tensioning thereof and with an angle at the apex of said groove substantially in excess of the angle of the ends of said teeth of said wedge assembly.

* * * * *